US011639246B2

(12) United States Patent
Thompson et al.

(10) Patent No.: US 11,639,246 B2
(45) Date of Patent: May 2, 2023

(54) CONTAINER AND PACKAGING SYSTEM

(71) Applicant: Ring Container Technologies, LLC, Oakland, TN (US)

(72) Inventors: Preston Forbes Thompson, Collierville, TN (US); Alex Dean Bevier, Olive Branch, MS (US)

(73) Assignee: RING CONTAINER TECHNOLOGIES, LLC, Oakland, TN (US)

( * ) Notice: Subject to any disclaimer, the term of this patent is extended or adjusted under 35 U.S.C. 154(b) by 19 days.

(21) Appl. No.: 15/630,180

(22) Filed: Jun. 22, 2017

(65) Prior Publication Data

US 2018/0370676 A1 Dec. 27, 2018

(51) Int. Cl.

| | |
|---|---|
| ***B65D 5/40*** | (2006.01) |
| ***B65D 85/72*** | (2006.01) |
| ***B65D 5/52*** | (2006.01) |
| ***B65D 25/56*** | (2006.01) |
| ***B65D 5/02*** | (2006.01) |
| ***B65D 5/42*** | (2006.01) |
| ***B65D 77/04*** | (2006.01) |

(52) U.S. Cl.

CPC ..... *B65D 5/40* (2013.01); *B65D 5/0227* (2013.01); *B65D 5/4204* (2013.01); *B65D 5/522* (2013.01); *B65D 25/56* (2013.01); *B65D 77/0426* (2013.01); *B65D 85/72* (2013.01)

(58) Field of Classification Search

CPC ..... B65D 5/40; B65D 5/522; B65D 85/72
See application file for complete search history.

(56) References Cited

U.S. PATENT DOCUMENTS

| | | | | |
|---|---|---|---|---|
| 3,499,582 | A * | 3/1970 | Sheldon | B65D 77/0426 206/386 |
| 3,666,167 | A * | 5/1972 | Watts | B65D 5/16 229/122 |
| 4,890,761 | A * | 1/1990 | Gaves | B65D 5/703 229/117.34 |
| 5,340,000 | A * | 8/1994 | Ring | B65D 1/20 222/468 |
| 6,045,036 | A * | 4/2000 | Ring | B65D 77/0426 220/23.86 |
| 7,708,186 | B2 * | 5/2010 | Pawlick | B65D 77/062 220/495.05 |
| 8,511,538 | B2 * | 8/2013 | Ouillette | B65D 5/46016 229/117.11 |
| D725,465 | S * | 3/2015 | Voelker | D9/430 |
| 2005/0139645 | A1 * | 6/2005 | Shean | B65D 5/029 229/109 |
| 2008/0073317 | A1 * | 3/2008 | Dygert | B65D 1/20 215/397 |

(Continued)

OTHER PUBLICATIONS

Mexican Institute of Industrial Property (MIIP), Office Action, Mexican Patent Appln. MX/a/2018/008672, dated Apr. 20, 2022.

*Primary Examiner* — Derek J Battisti
(74) *Attorney, Agent, or Firm* — Sorell, Lenna & Schmidt, LLP

(57) ABSTRACT

A packaging comprising a container configured for disposal of a volume of flowable material. A carton configured for disposal of the container, the carton including a wall defining an opening. Visual indicia of the volume is provided. Packaging products, containers, handles, tooling, applicators and methods are disclosed.

20 Claims, 14 Drawing Sheets

(56) References Cited

U.S. PATENT DOCUMENTS

| | | | | |
|---|---|---|---|---|
| 2012/0312813 | A1* | 12/2012 | Voelker | B65D 5/4204 220/23.89 |
| 2013/0068764 | A1* | 3/2013 | Kuhar | B65D 25/2897 220/23.83 |
| 2016/0031604 | A1* | 2/2016 | Kessler | B65D 25/54 220/662 |

* cited by examiner

CONTAINER AND PACKAGING SYSTEM

TECHNICAL FIELD

The present invention generally relates a container and package system and methods for making the same for food packaging.

BACKGROUND

Food packaging containers can be used with a variety of products. In some cases, such containers are blow molded from suitable plastic resins in a range of shapes and sizes. The empty blow-molded containers can be filled with food, food preparation and/or beverage products at a fill site utilizing automated fill equipment. These food packaging containers, however, can be difficult in handling, for example, to carry and dispense the food, food preparation and/or beverage products.

In some cases, a packaging system includes the food packaging container and an external box, which houses the container and facilitates handling. The box can provide strength and/or protection. The box can also provide packaging for stacking and transport, as well as a surface for advertising and labeling materials relating to the product contained therein. This disclosure describes an improvement over these prior technologies.

SUMMARY

In one embodiment, packaging for food, food preparation and/or beverage products is provided. The packaging comprises a container configured for disposal of a volume of flowable material. A carton is configured for disposal of the container. The carton includes a wall defining an opening. The packaging includes visual indicia of the volume. In some embodiments, packaging products, containers, handles, tooling, applicators and methods are disclosed.

In one embodiment, the packaging comprises a food container including a wall and a handle. The wall is configured for disposal of a volume of edible and/or cooking oil that is visually perceptible from at least a portion of the wall. A box carton, which includes a top surface, a bottom surface and a wall, is configured for disposal of the container. The wall of the box carton defines an opening that is aligned with the at least a portion of the wall to provide visual indicia of the volume.

In one embodiment, a method of assembling food packaging is provided. The method comprises the steps of: cutting a sheet into a selected configuration, the sheet including a wall defining an opening; folding the sheet into a carton for disposal of a container that is configured for disposal of a volume of flowable material; and disposing the container in the carton such that the opening is aligned with the container to provide visual indicia of the volume.

BRIEF DESCRIPTION OF THE DRAWINGS

The present disclosure will become more readily apparent from the specific description accompanied by the following drawings, in which.

DETAILED DESCRIPTION

Figure 1:
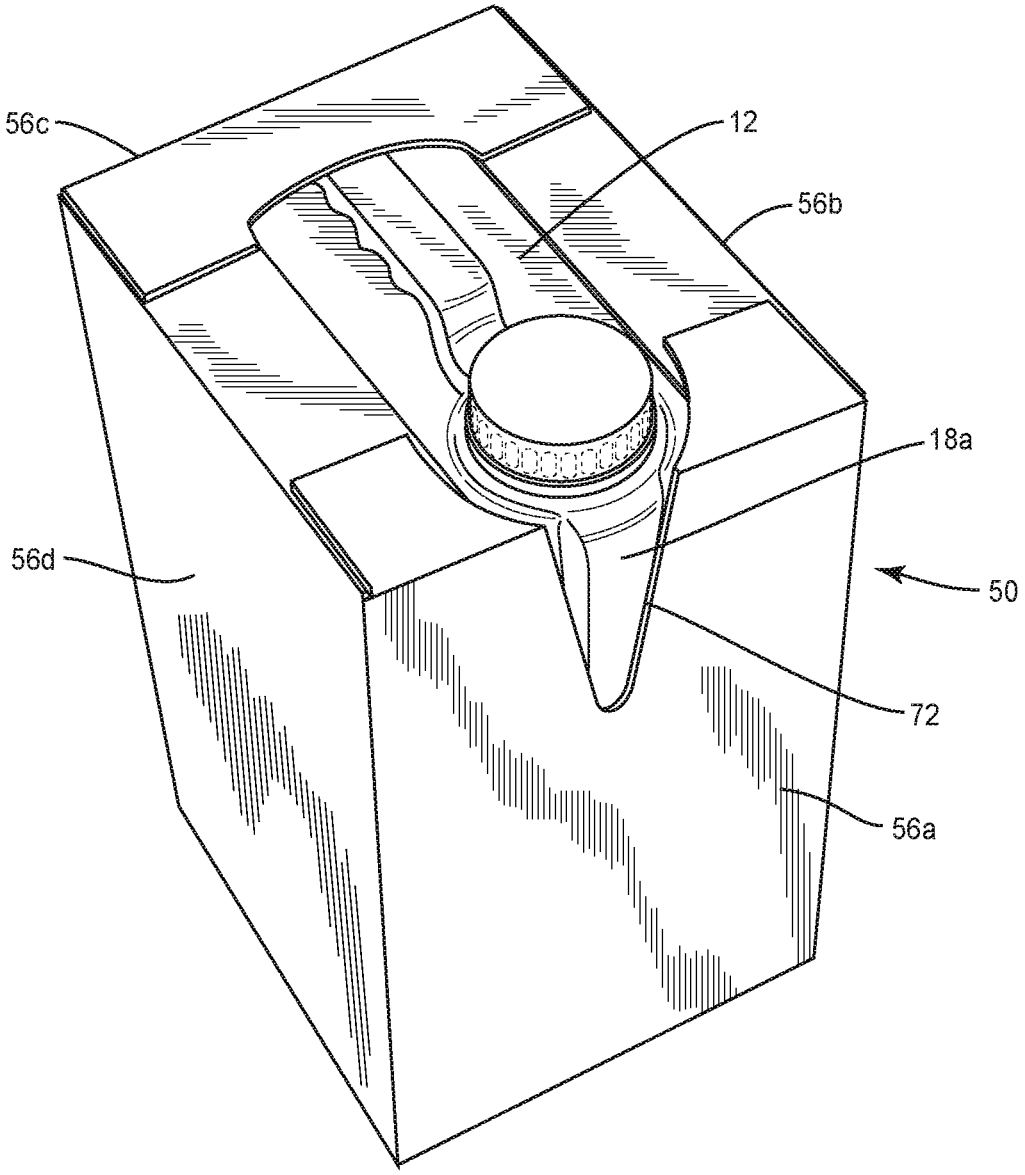
FIG. 1 is a perspective view of components of one embodiment of a packaging system in accordance with the principles of the present disclosure.

The exemplary embodiments of a food packaging system, assembly of its components and related methods of use disclosed are discussed in terms of packaging systems and more particularly, in terms includes a container and a box for food, food preparation and/or beverage products. In some embodiments, the box encases the container. In some embodiments, the box is configured to facilitate stacking and carrying of the container. In some embodiments, the box includes an opening configured to provide visual indicia of a fill level of the container. In some embodiments, the container can be filled with liquids, food, food preparation and/or beverage products. In some embodiments, the container may be made of plastic, for example, polyethylene terephthalate (PET), which can be blow molded into various configurations. In some embodiments, the container can be filled with food, food preparation oils, viscous and/or beverage products. In some embodiments, the container can be employed as a cold fill container. In some embodiments, the container can be employed as a hot fill container. In some embodiments, the container includes a large plastic container for edible oil packaging.

In some embodiments, the box includes an opening configured to facilitate viewing of indicia, such as, for example, a fill level of a volume of material within the container. In some embodiments, the opening is disposed along a front side of the box. In some embodiments, the opening is disposed in communication with the opening in the top cover to extend the bottle neck opening along the front side. In some embodiments, the opening is configured to facilitate validating a height of a fill level. In some embodiments, the opening is configured to facilitate determination of an adequate fill level. In some embodiments, the opening is configured to facilitate comparing fill levels of multiple containers. In some embodiments, the opening is disposed along a back side. In some embodiments, the opening includes a diamond configuration. In some embodiments, the opening includes a hinged flap disposed on the back side. In some embodiments, the opening includes a circular configuration. In some embodiments, the box is configured to withstand a compression force of 1112 pounds with a standard deviation of 68 pounds.

In some embodiments, the container includes a top, a bottom, and sides extending from the top to the bottom. In some embodiments, the container includes a spout for inserting and removing contents from the container. In some embodiments, the container includes a first handle portion on the top and extending generally in a direction front to back. In some embodiments, the container includes a second handle portion on the top and extending in a direction transverse to the first handle portion. In some embodiments, the container includes a manual grip on the bottom of the container. In some embodiments, the box includes a top cover, a bottom cover and side portions extending from the top cover to the bottom cover. The box includes a front side and a back side, one or more openings on the top cover that expose the spout for pouring the contents of the container and accessing the second handle portion. In some embodiments, the openings are configured to facilitate manually grasping the first handle portion. In some embodiments, the box includes an opening in the bottom cover that exposes the bottom grip.

In some embodiments, the container includes blow-molded plastic jugs or bottles. In some embodiments, the container includes a 35 pound or 5 gallon jug. In some embodiments, the container is manufactured via an injection molded preform, which is subjected to a blow mold process. In some embodiments, the container is manufactured and subjected to a trimming process.

The present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. Also, in some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of components of a packaging system, methods of assembly and manufacturing the packaging system. Alternate embodiments are also disclosed. Reference is made in detail to the exemplary embodiments of the present disclosure, which are illustrated in the accompanying figures. Turning to FIGS. 1-8, there are illustrated components of a packaging system 10.

Packaging system 10 includes a container 12. Container 12 includes a top 14 and a bottom 16 connected by walls 18*a*, 18*b*, 18*c* and 18*d*. Walls 18*a*, 18*b*, 18*c*, 18*d* extend from top 14 to bottom 16. Container 12 includes a handle 32. In some embodiments, handle 32 is disposed with top 14. In some embodiments, handle 32 may be disposed at various positions on container 12. In some embodiments, container 12 includes a grip (not shown) disposed with bottom 16. In some embodiments, handle 32 and/or the grip may include various shapes, such as, for example, circle, triangle, square, rectangle, oval, irregular shapes, or a combination thereof.

Walls 18*a*, 18*b*, 18*c*, 18*d* include a surface 20 that defines a cavity 22. Cavity 22 is configured for disposal of a volume V of a flowable material 24. In some embodiments, material 24 can include, for example, liquids, food, food preparation and/or beverage products. Container 12 includes a spout 38 configured to facilitate filling and/or pouring of volume V of material 24 with the interior space of container 12.

Packaging system 10 includes indicia for viewing a measure of volume V disposed with the interior space of container 12. For example, the indicia includes a window W and a fill level F of container 12 configured to display a volume V of material 24 being disposed with the interior space of container 12. Window W and fill level F are disposed with wall 18*a*. In some embodiments, the indicia includes fill level F, which represents a volume of material 24 corresponding to a filled container 12, maximum volume of container 12, range of volume of container 12 and/or other selected volume.

Figure 2:
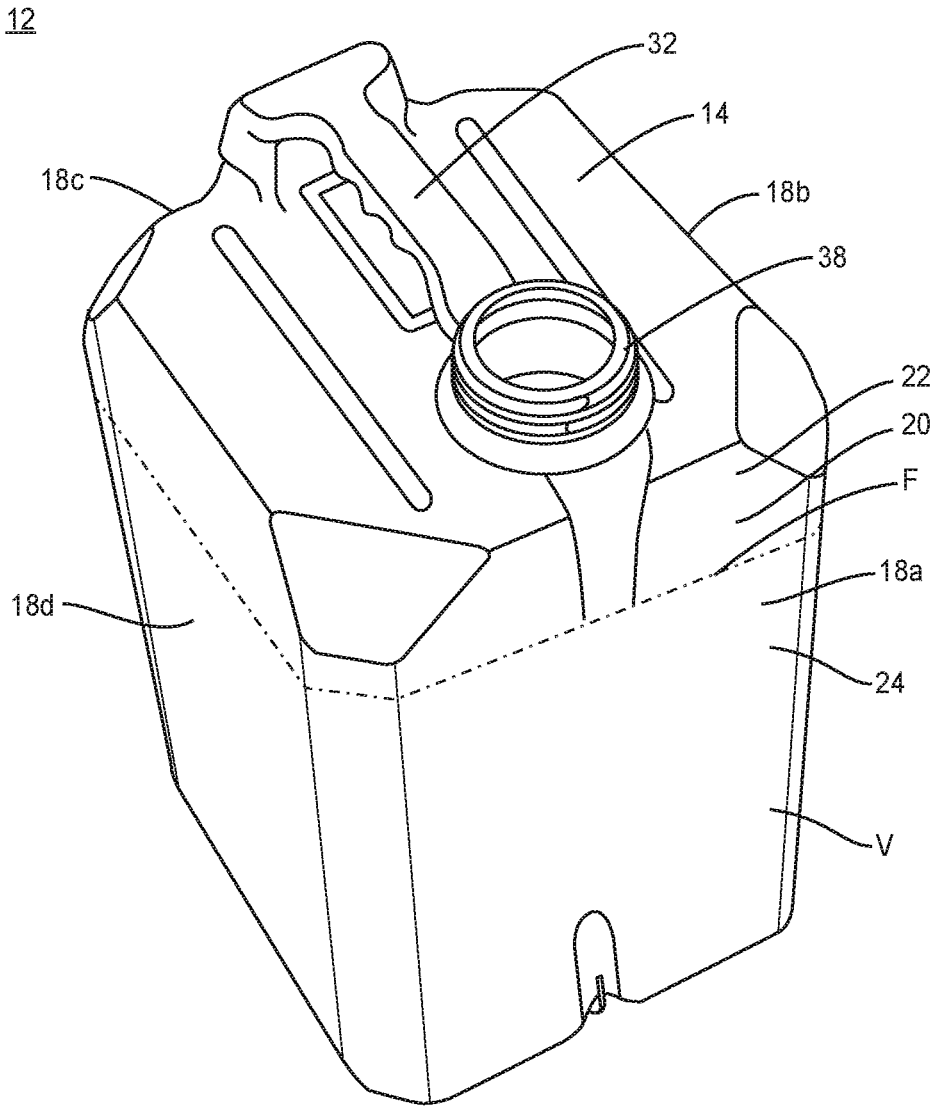
FIG. 2 is a perspective view in part phantom of components of one embodiment of a packaging system in accordance with the principles of the present disclosure.
Figure 3:
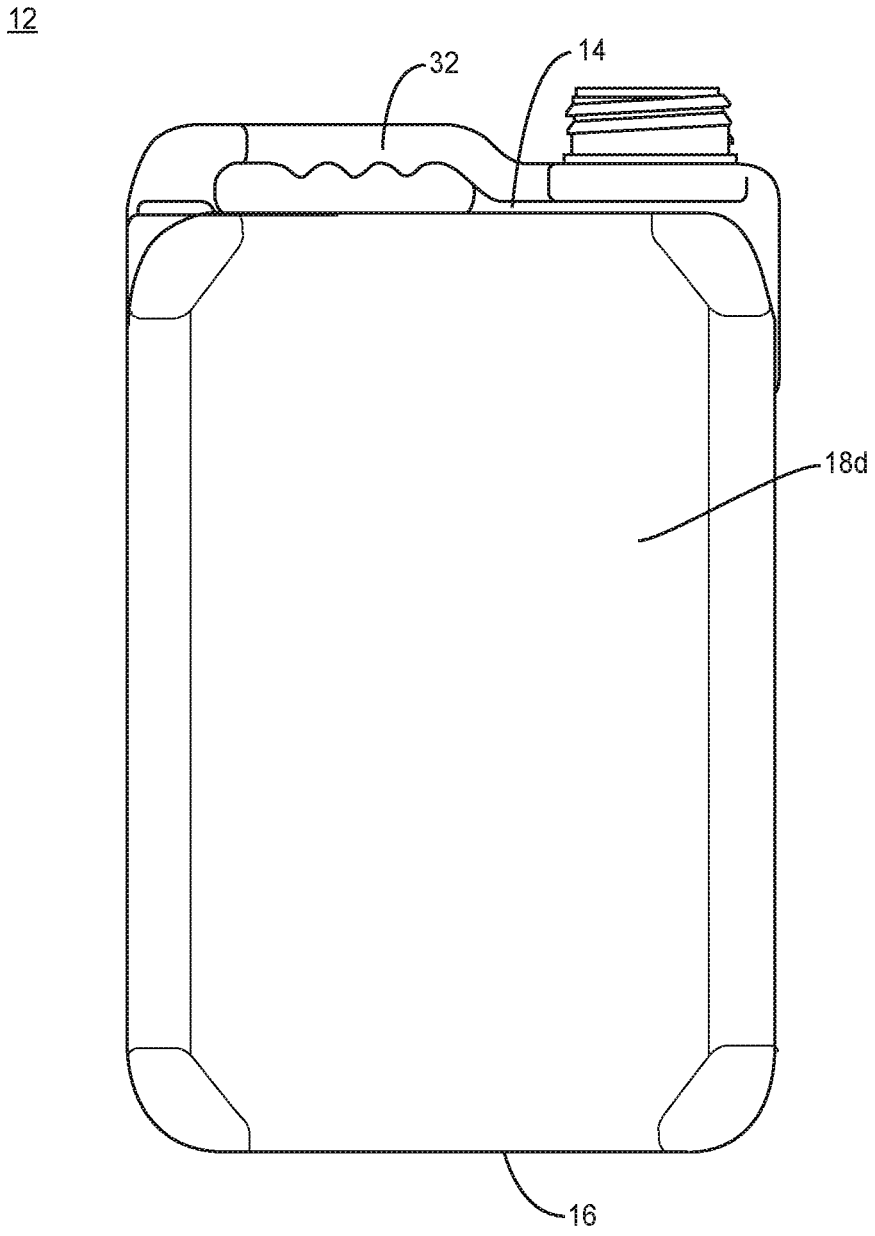
FIG. 3 is a side view of the components shown in FIG. 2.

In some embodiments, the indicia includes one or more walls 18*a*, 18*b*, 18*c* and 18*d* comprising a transparent or semi-transparent material to facilitate viewing of a measure of volume V relative to fill level F, as shown in FIG. 2. In some embodiments, the indicia includes one or more of walls 18*a*, 18*b*, 18*c*, 18*d* comprising a semi-transparent material and a transparent window to facilitate viewing of a measure of volume V relative to fill level F. In some embodiments, the indicia includes one or more of walls 18*a*, 18*b*, 18*c*, 18*d* comprising an opaque material and a transparent window to facilitate viewing of a measure of volume V relative to fill level F. In some embodiments, the indicia including transparent, semi-transparent or opaque surfaces or portions of container 12 and/or carton 50, may have transparent, semi-transparent or opaque properties, such as the transparent, semi-transparent or opaque properties corresponding to the material examples described above, such that the indicia can be employed to visualize a measure of volume V relative to fill level F.

In some embodiments, the indicia includes markings, such as, for example, graduations disposed on container 12 to indicate fill level F and/or volumetric levels of the amount of material 24 or contents of container 12. In some embodiments, the indicia includes a marking indicating a desired quantity of material 24 to be disposed within container 12. In some embodiments, the indicia includes fill level F comprising a straight line, perforated line, curved line, undulating, an icon, a slot or groove.

In some embodiments, the indicia includes markings that may be disposed in increments of measurement. In some embodiments, the indicia may include human readable visual indicia, such as, for example, a label, color coding, alphanumeric characters or an icon. In some embodiments, the indicia may be a printed or written item in combination with a slot or groove, whereby the printed or written item is placed in the slot or groove to display information. In some embodiments, the indicia may be applied as an adhesive.

In some embodiments, container 12 includes a finished PET blow-molded container 12, as shown in FIG. 2. In some embodiments, container 12 is constructed for use with a selected packaging application, such as, for example, filling, storage and/or dispensing of food, edible food preparation oils, viscous and/or beverage products. In some embodiments, container 12 is manufactured via a two-stage method and is formed by injection molding. In some embodiments, a preform is placed into a cavity of a mold assembly to be blown. In some embodiments, container 12 is manufactured with a low center of gravity.

In some embodiments, container 12 may be fabricated from plastic and formed using injection and compression molding processes. In some embodiments, container 12 may be fabricated from polyester (PES), polyethylene (PE), high-density polyethylene (HDPE), polyvinyl chloride (PVC), polyvinylidene chloride (PVDC) (Saran), low-density polyethylene (LDPE), polypropylene (PP), polystyrene (PS), high impact polystyrene (HIPS), polyamides (PA) (Nylons), acrylonitrile butadiene styrene (ABS), polyethylene/acrylonitrile butadiene styrene (PE/ABS), polycarbonate (PC), polycarbonate/acrylonitrile butadiene styrene (PC/ABS), and/or polyurethanes (PU).

Figure 8:
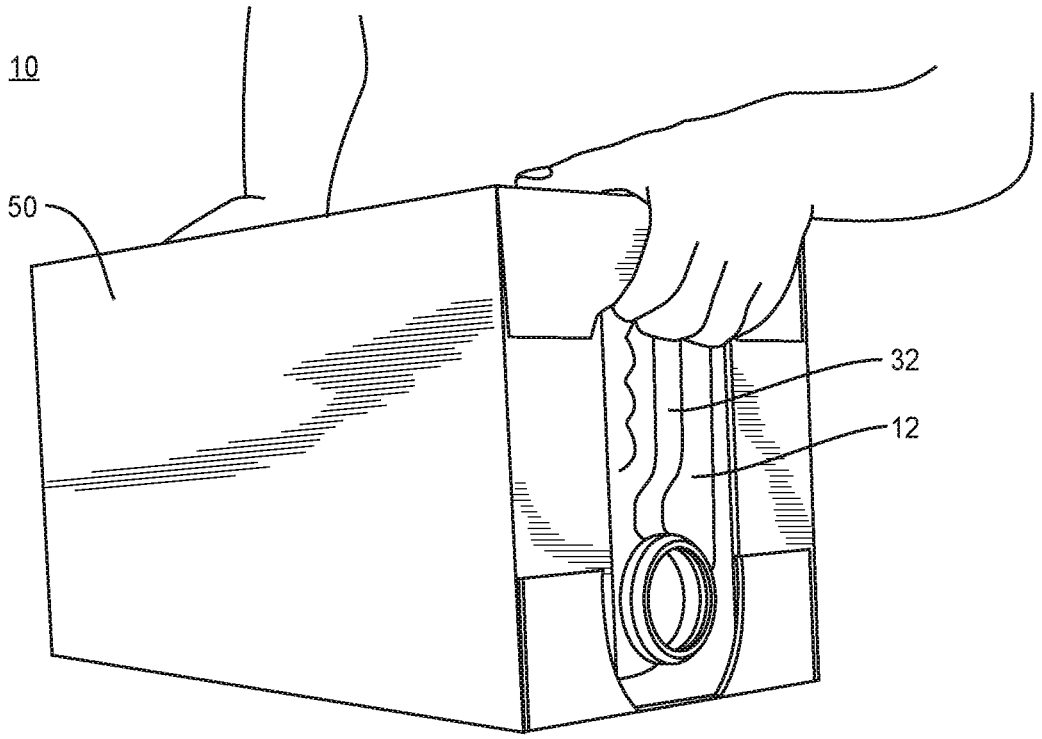
FIG. 8 is a perspective view of components of one embodiment of a packaging system in accordance with the principles of the present disclosure.

Packaging system 10 includes a box carton 50. Carton 50 is configured to enclose container 12. Carton 50 is configured to facilitate carrying container 12, as shown in FIG. 8. Carton 50 is configured to facilitate stacking of containers for transport and/or display. Carton 50 includes a top cover 52, a bottom cover 54 and a plurality of walls 56*a*, 56*b*, 56*c* and 56*d* that define a cavity 58. Top cover 52 directly engages handle 32 when container 12 is positioned within carton 50, as shown in FIG. 1, for example. That is, there is no gap between top cover 52 and handle 32 when container 12 is positioned within carton 50. Top cover 52 includes a surface 60 that defines an opening 62. Opening 62 is configured for disposal of spout 38 such that spout 38 is exposed to facilitate dispensing material 24. In some embodiments, bottom cover 54 includes a surface 64 that defines an opening 66. Opening 66 is configured to provide access to grip 34.

The visual indicia of volume V includes a surface 70 that defines an opening 72 for display of a measure of volume V relative to fill level F. Opening 72 is configured for selective orientation relative to wall 56*a* to facilitate visualizing material 24 within container 12, as described herein. Opening 72 includes a V-shaped configuration and is disposed in communication with opening 62. In some embodiments, opening 72 is disposed in a perpendicular orientation relative to opening 62. In some embodiments, the visual indicia can include one or more openings oriented with one or more of walls 56*a*, 56*b*, 56*c* and 56*d* to view a measure of volume V.

Opening 72 is aligned with fill level F and provides an area through wall 56*a* to view volume V relative to fill level F. Opening 72 is aligned with fill level F to provide visual indicia of an amount of volume V within container 12. For example, opening 72 is disposed adjacent wall 18*a* such that volume V is visualized through transparent or semi-transparent wall 18*a* and opening 72. Opening 72 is configured to provide a visual indicator of volume V within container 12. In some embodiments, opening 72 is configured to provide a visual comparison of volume V in container 12 with an adjacent container 12.

Figure 6:
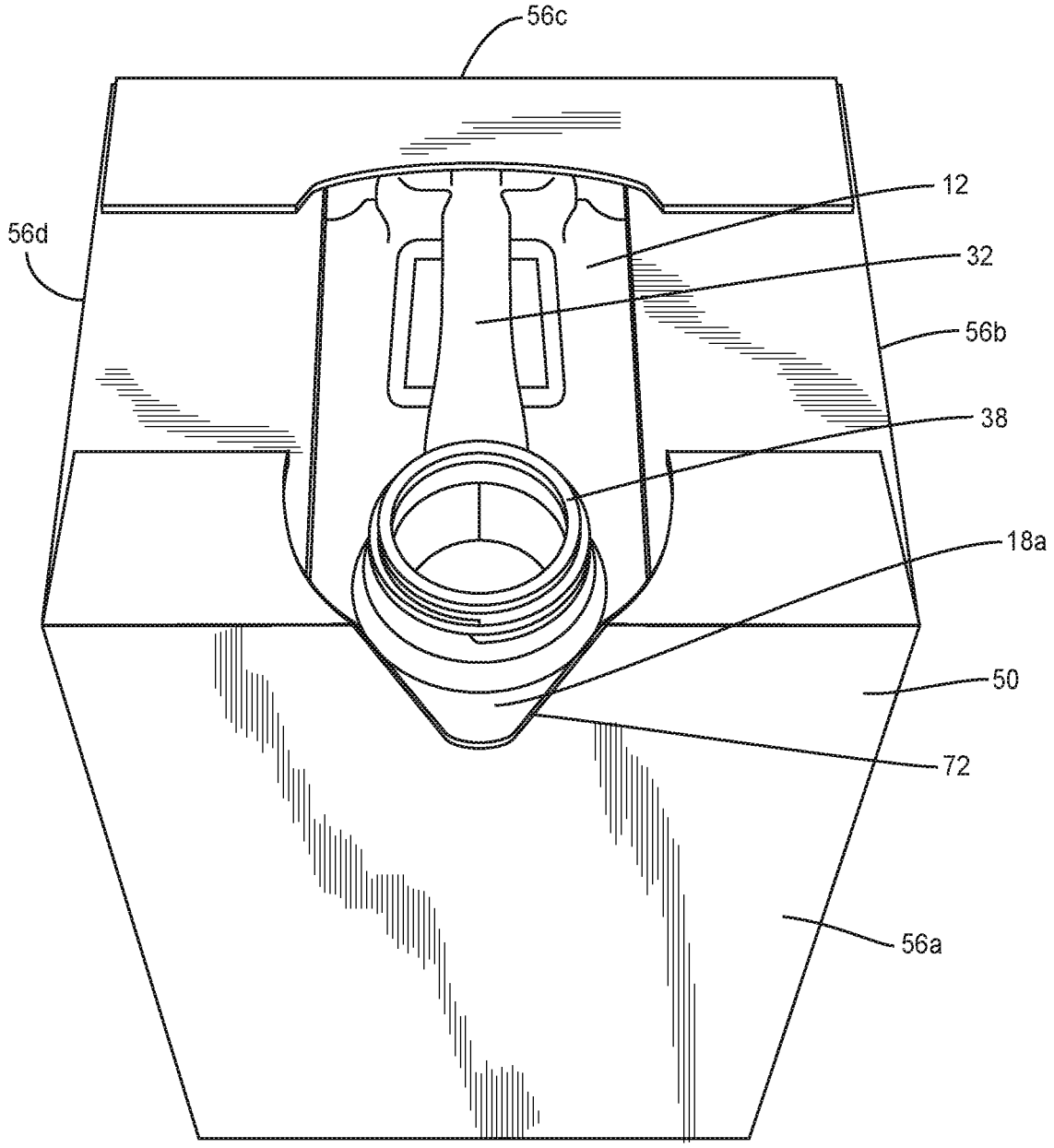
FIG. 6 is a perspective view of components of one embodiment of a packaging system in accordance with the principles of the present disclosure.
Figure 7:
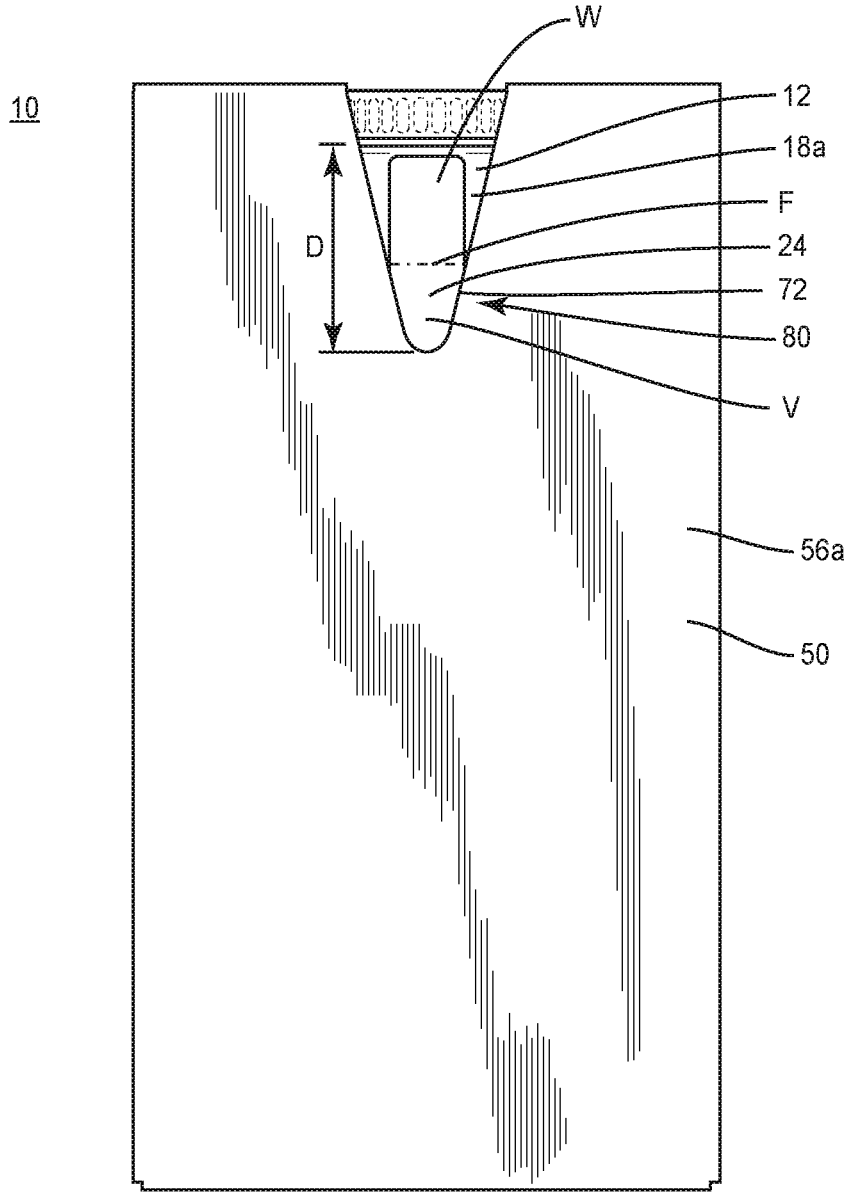
FIG. 7 is a font view of the components shown in FIG. 6.

In some embodiments, when container 12 is disposed with cavity 58, wall 56*a* is oriented adjacent wall 18*a*, wall 56*b* is oriented adjacent wall 18*b*, wall 56*c* is oriented adjacent wall 18*c* and wall 56*d* is oriented adjacent wall 18*d*. Opening 72 is disposed with wall 18*a*, as shown in FIGS. 6 and 7. Opening 72 extends along a distance D of wall 18*a* to expose a portion of container 12 such that the visual indicia displays a measure of volume V.

Figure 4:
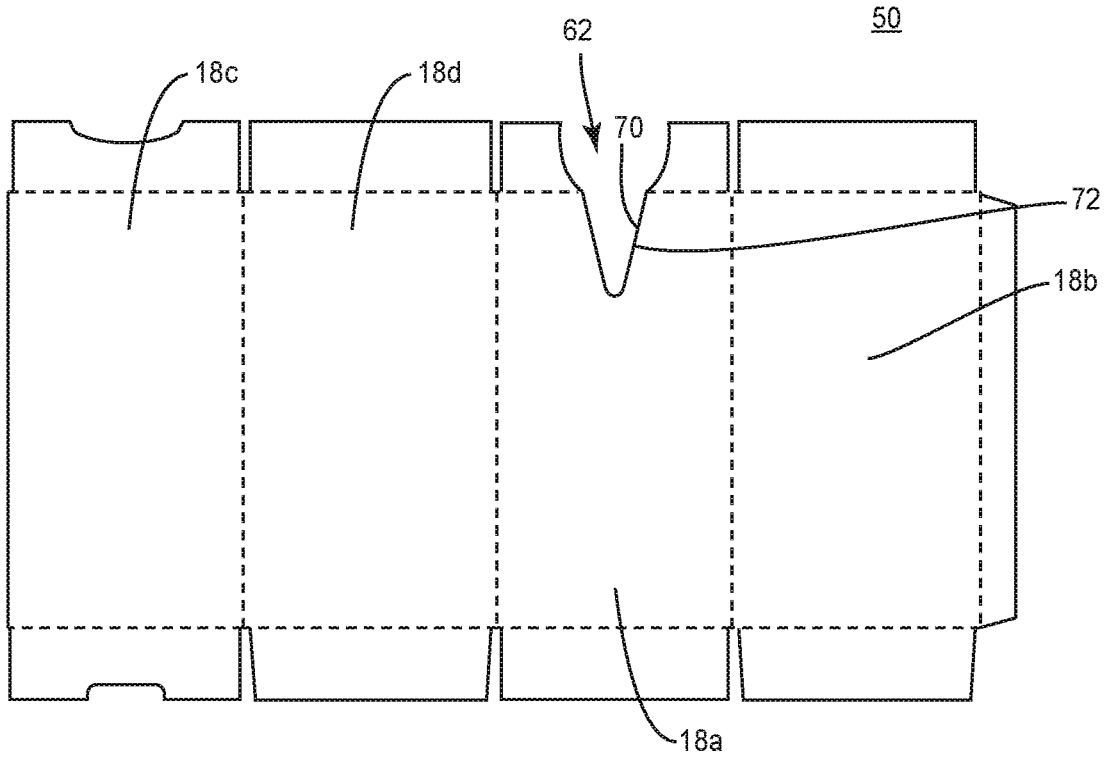
FIG. 4 is a plan view of components of one embodiment of a packaging system in accordance with the principles of the present disclosure.
Figure 5:
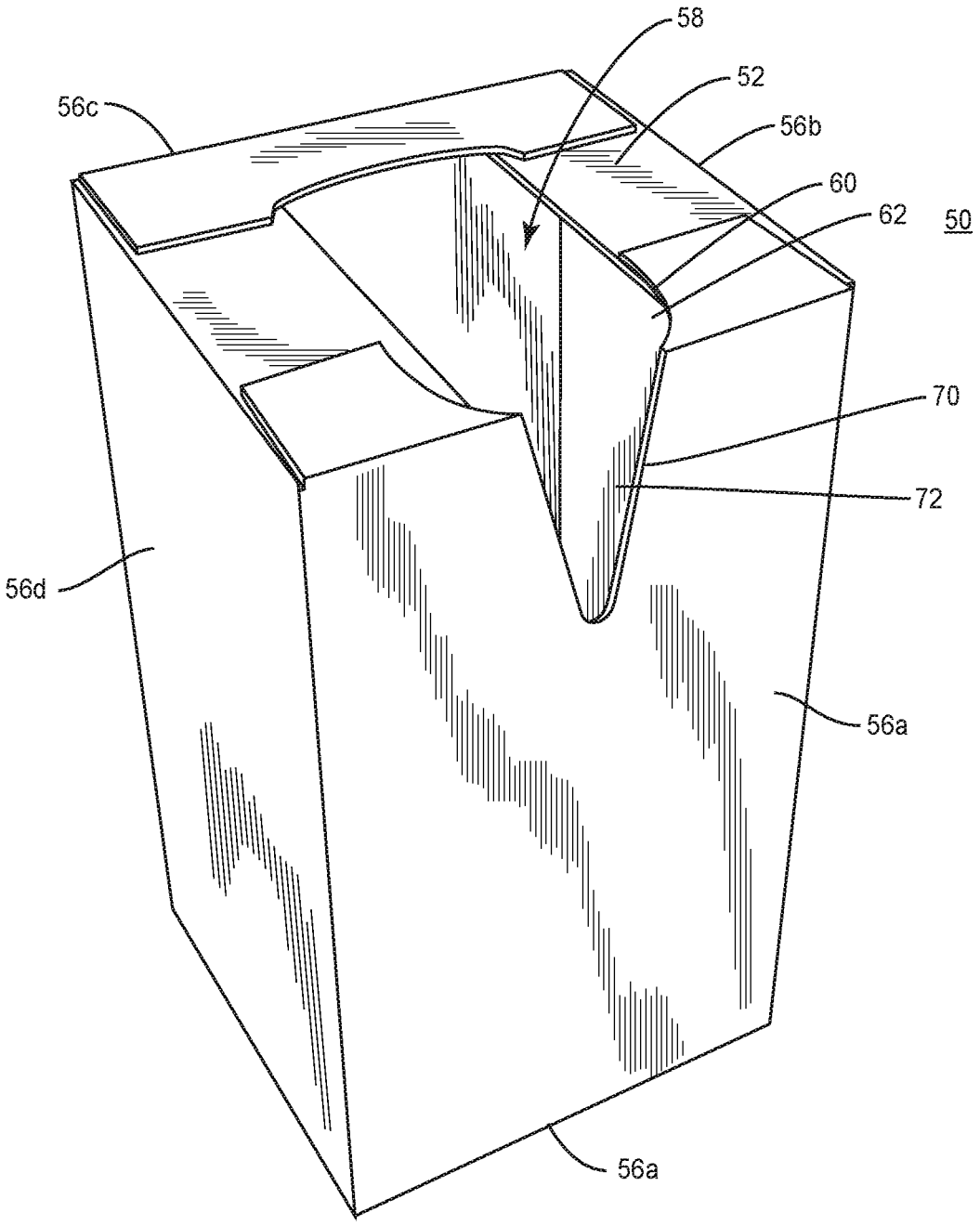
FIG. 5 is a perspective view of components of one embodiment of a packaging system in accordance with the principles of the present disclosure.

In assembly and use, a sheet 100 is cut by a die-cutter into a selected configuration of carton 50, as shown in FIG. 4. In some embodiments, a trimmer cuts a design of carton 50, such as, for example, openings 62, 72 and flaps that form walls 56*a*, 56*b*, 56*c*, 56*d*. In some embodiments, the trimmer includes sharp and rubber blades to allow for forming lines that are scored not cut. A bending machine folds sheet 100 along scored lines and glue or stitches is applied to form assembled carton 50.

Container 12 is formed by blow-molding, as shown in FIG. 2. Container 12 is pre-filled via an automated fill machine. Container 12 is filled to a fill level F with a selected volume V of material 24. Container 12 is disposed within the cavity of carton 50. Container 12 is oriented with carton 50 such that opening 72 is aligned with wall 18*c* of container 12 to provide visual indicia of volume V relative to fill level F. The visual indicia of fill level F includes opening 72, which provides an area through carton 50 to view fill level F of volume V. In some embodiments, opening 72 is configured to provide a visual comparison of volume V in container 12 with an adjacent container 12, for example, to facilitate stacking of packaging 10 in a side by side relation to compare volumes V in each packaging 10. Carton 50 facilitates gripping of container 12 for carrying and/or pouring material 24.

Figure 9:
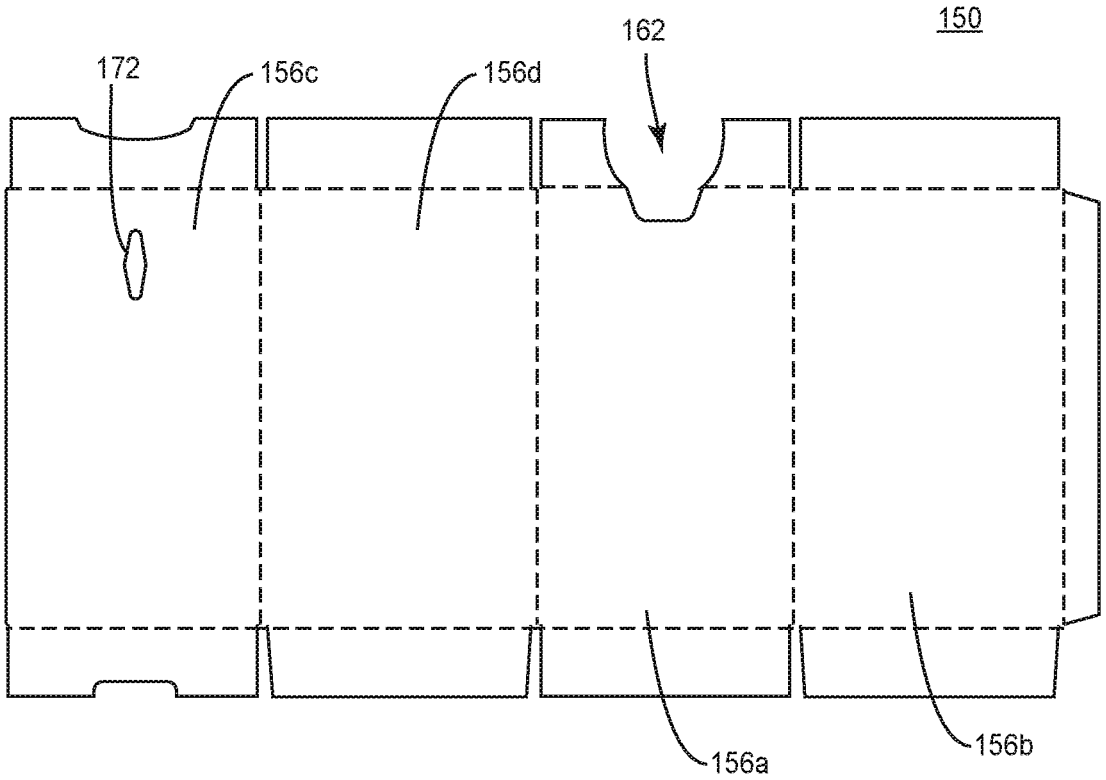
FIG. 9 is a plan view of components of one embodiment of a packaging system in accordance with the principles of the present disclosure.
Figure 10:
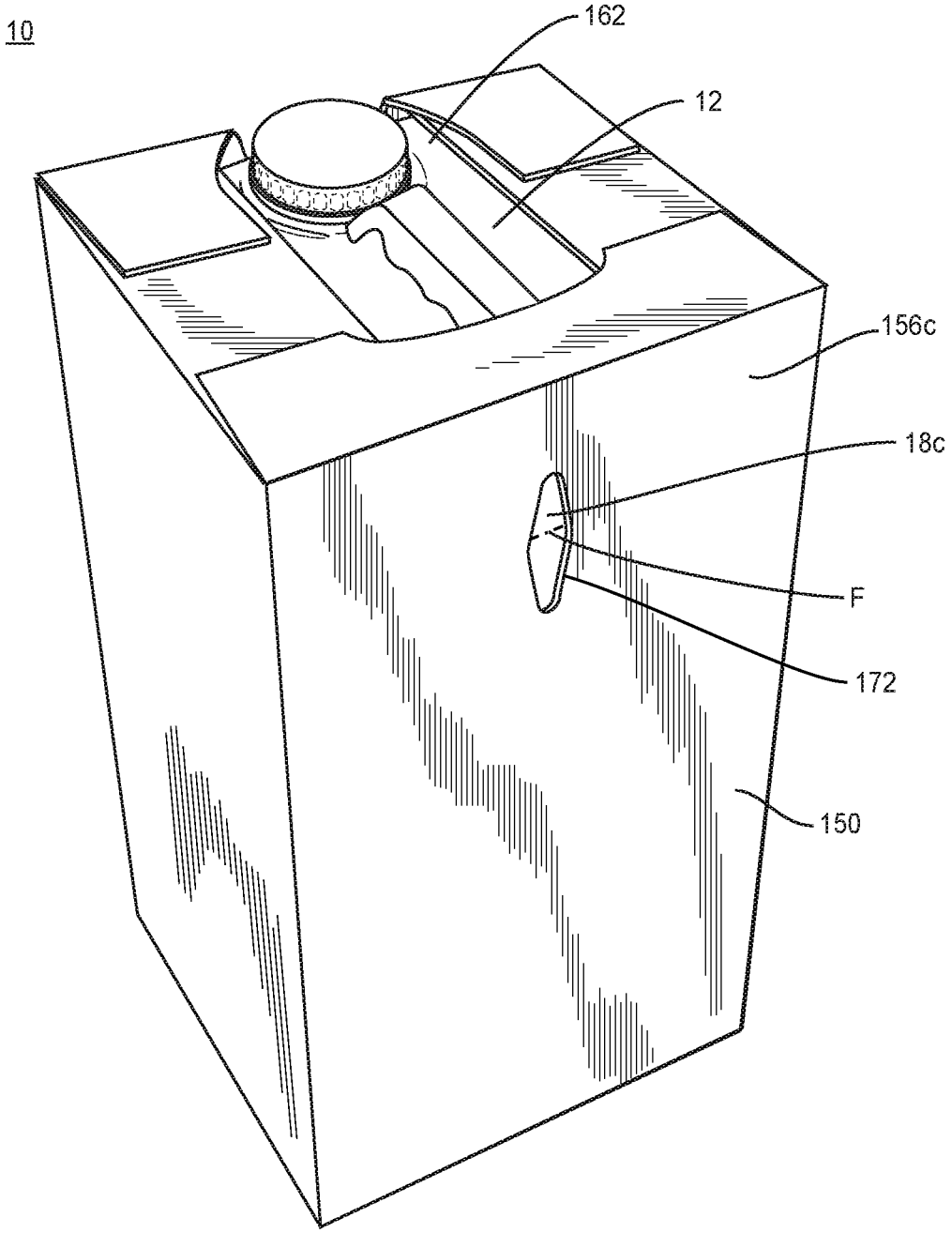
FIG. 10 is a perspective view of components of one embodiment of a packaging system in accordance with the principles of the present disclosure.

In one embodiment, as shown in FIGS. 9 and 10, packaging system 10, similar to the systems and methods described herein, includes container 12, as described herein, a carton 150, similar to carton 50 described herein, and indicia, similar to the indicia for viewing a measure of a volume V disposed with the interior space of container 12 described herein. Carton 150 includes a top cover, a bottom cover and a plurality of walls 156*a*, 156*b*, 156*c* and 156*d* that define a cavity. The top cover defines an opening 162.

The visual indicia includes a surface of carton 150 that defines a diamond shaped opening 172 for display of a measure of volume V relative to a fill level F, similar to that described herein and which is disposed with wall 18*c*. Opening 172 is configured for selective orientation relative to wall 156*c* to facilitate visualizing material 24 within container 12, as described herein. Opening 172 is vertically elongated and spaced apart from opening 162. The visual indicia includes opening 172 disposed with back wall 156*c* to display volume V relative to fill level F disposed with back wall 18*c*, oriented opposite the spout of container 12.

Opening 172 is aligned with fill level F and provides an area through wall 156*c* to view volume V relative to fill level F. Opening 172 is aligned with fill level F to provide visual indicia of an amount of volume V within container 12. For example, opening 172 is disposed adjacent wall 18*c* such that volume V is visualized through transparent or semi-transparent wall 18*c* and opening 172. Opening 172 is configured to provide a visual indicator of volume V within container 12. In some embodiments, opening 172 is configured to provide a visual comparison of volume V in container 12 with an adjacent container 12.

Figure 11:
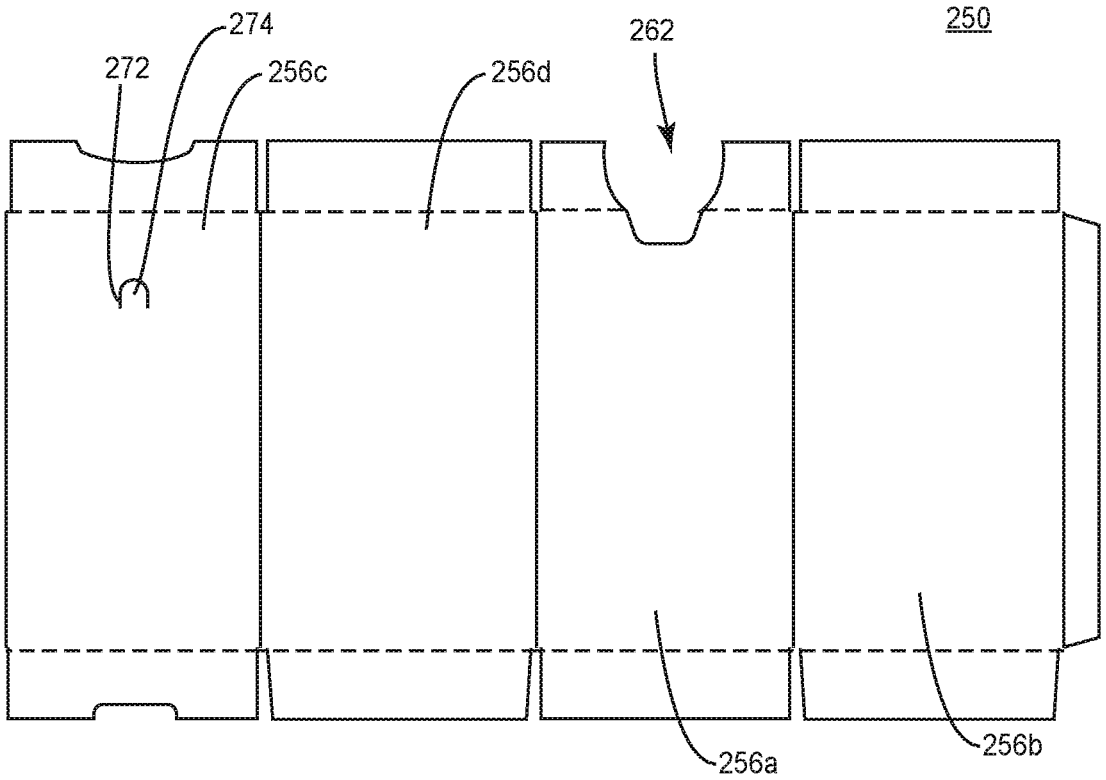
FIG. 11 is a plan view of components of one embodiment of a packaging system in accordance with the principles of the present disclosure.
Figure 12:
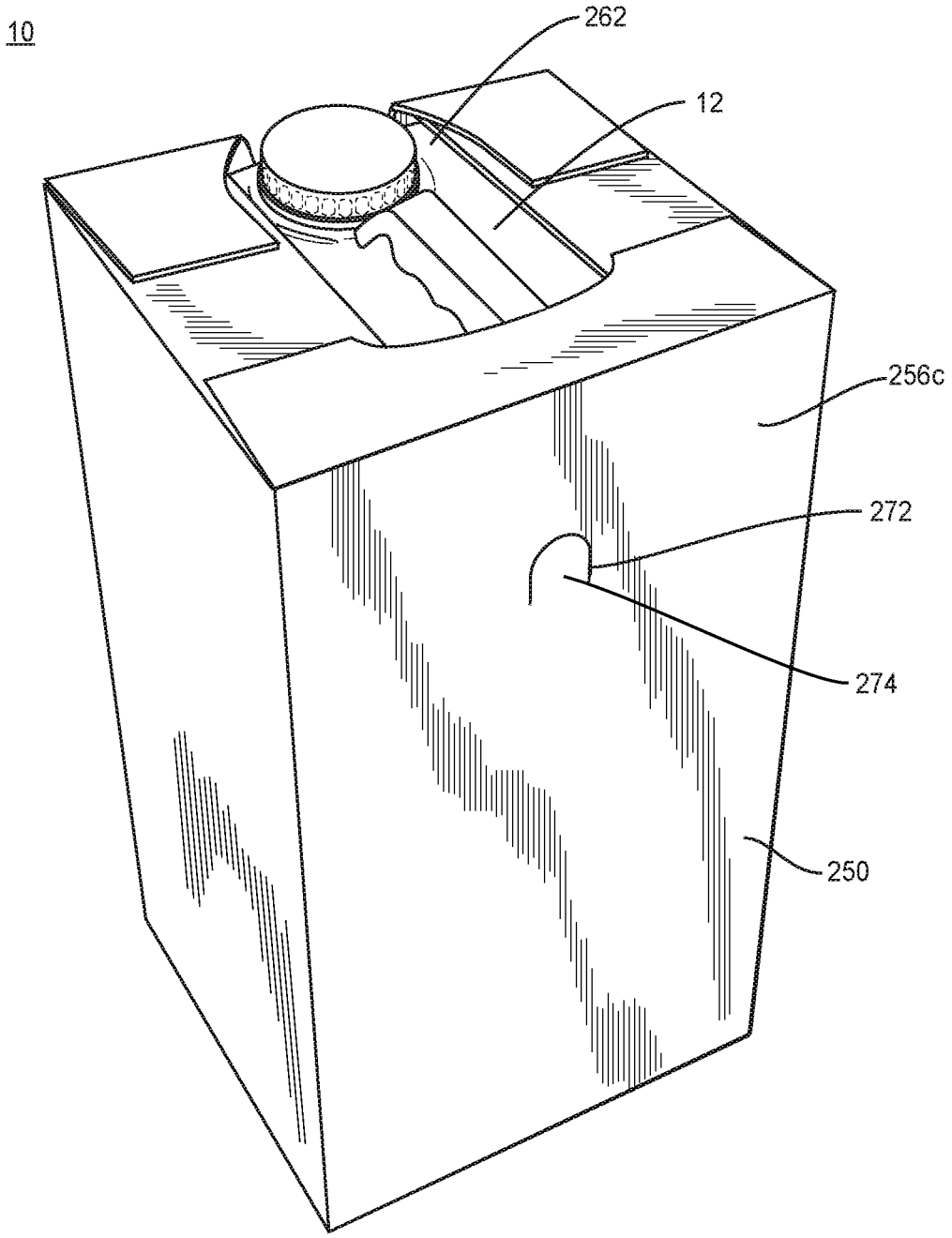
FIG. 12 is a perspective view of components of one embodiment of a packaging system in accordance with the principles of the present disclosure.

In one embodiment, as shown in FIGS. 11 and 12, packaging system 10, similar to the systems and methods described herein, includes container 12, as described herein, a carton 250, similar to carton 50 described herein, and indicia, similar to the indicia for viewing a measure of a volume V disposed with the interior space of container 12 described herein. Carton 250 includes a top cover, a bottom cover and a plurality of walls 256*a*, 256*b*, 256*c* and 256*d* that define a cavity. The top cover defines an opening 262.

The visual indicia includes a surface of carton 250 that defines a hinged flap 274 that covers a U-shaped opening 272. Flap 274 is pivotable out of alignment with opening 272 such that opening 272 displays a measure of volume V relative to a fill level F (not shown), similar to that described herein and which is disposed with wall 18*c*. Opening 272 is configured for selective orientation relative to wall 256*c* to facilitate visualizing material 24 within container 12, as described herein. The visual indicia includes opening 272 disposed with back wall 256*c* to display volume V relative to fill level F disposed with back wall 18*c*, oriented opposite the spout of container 12.

Opening 272 is aligned with fill level F and provides an area through wall 256*c* to view volume V relative to fill level F. Opening 272 is aligned with fill level F to provide visual indicia of an amount of volume V within container 12. For example, opening 272 is disposed adjacent wall 18*c* such that volume V is visualized through transparent or semi-transparent wall 18*c* and opening 272. Opening 272 is configured to provide a visual indicator of volume V within container 12. In some embodiments, opening 272 is configured to provide a visual comparison of volume V in container 12 with an adjacent container 12.

Figure 13:
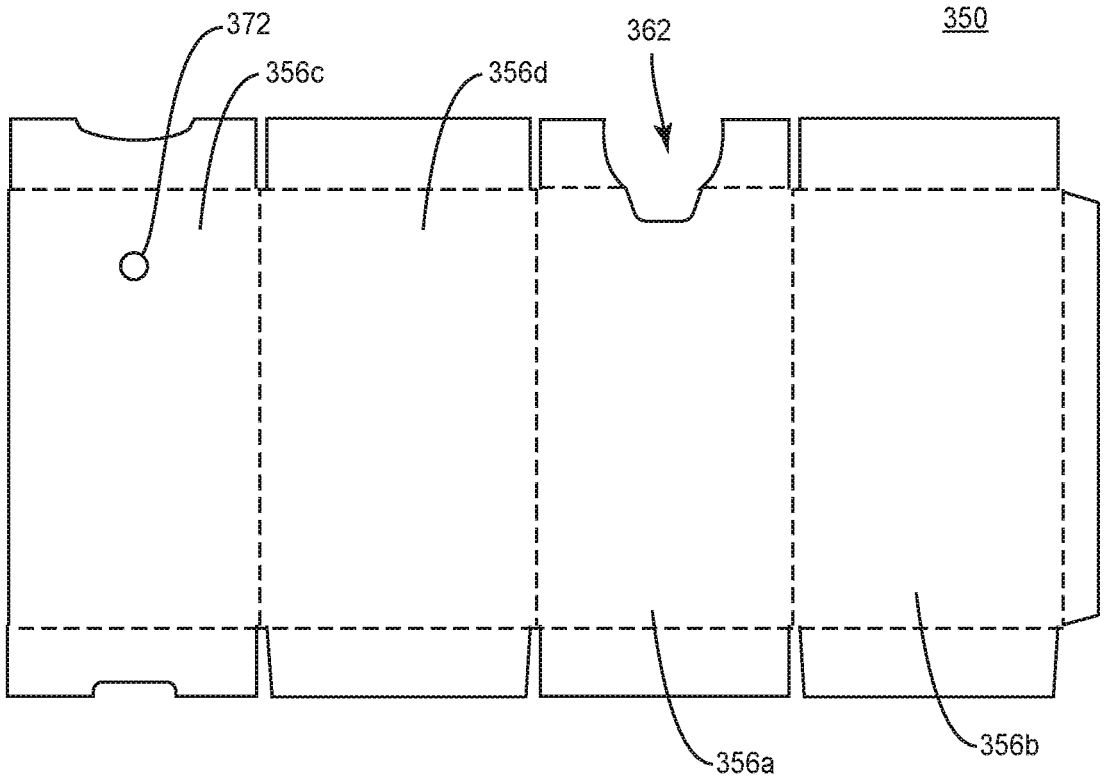
FIG. 13 is a plan view of components of one embodiment of a packaging system in accordance with the principles of the present disclosure.
Figure 14:
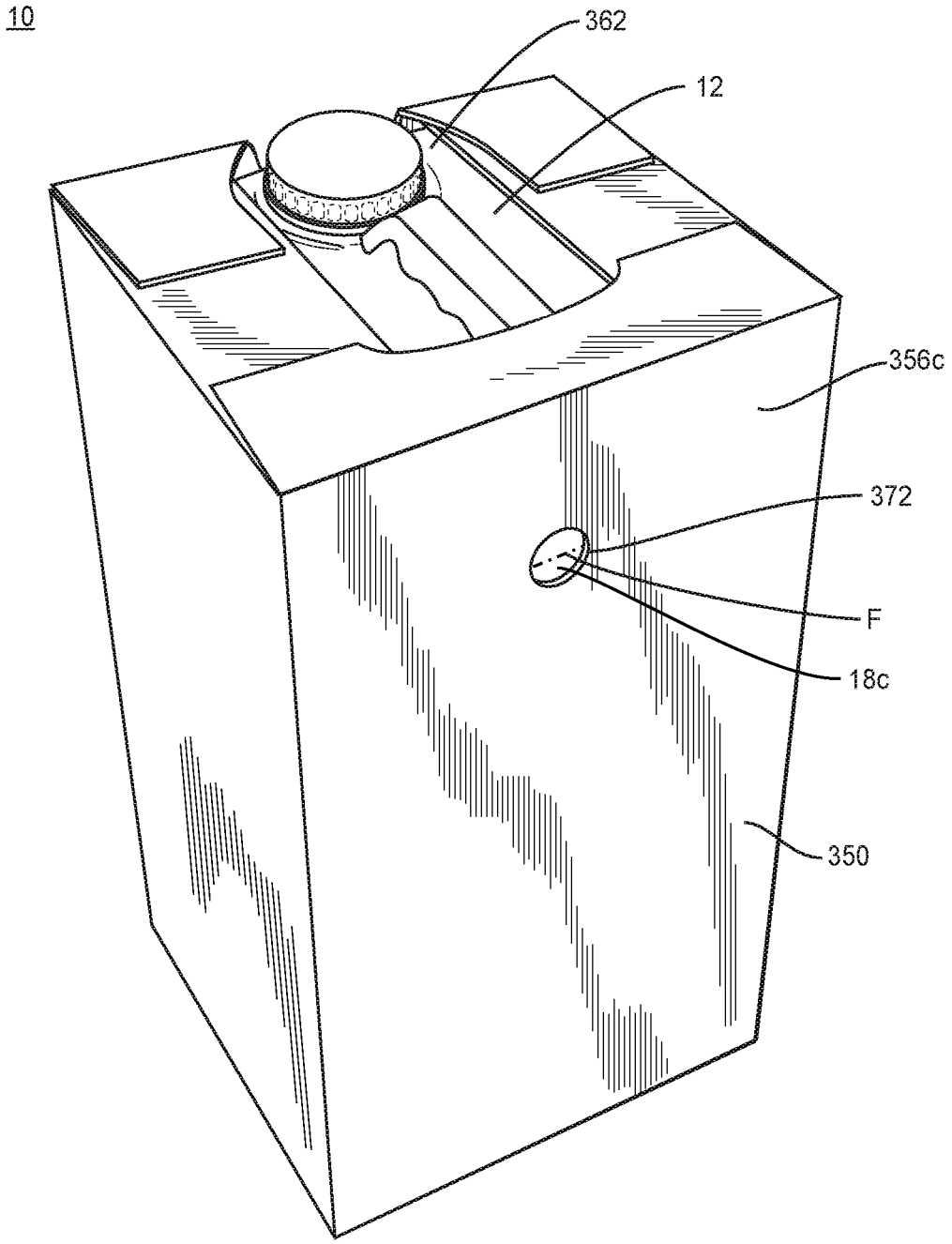
FIG. 14 is a perspective view of components of one embodiment of a packaging system in accordance with the principles of the present disclosure.

In one embodiment, as shown in FIGS. 13 and 14, packaging system 10, similar to the systems and methods described herein, includes container 12, as described herein, a carton 350, similar to carton 50 described herein, and indicia, similar to the indicia for viewing a measure of a volume V disposed with the interior space of container 12 described herein. Carton 350 includes a top cover, a bottom cover and a plurality of walls 356*a*, 3156*b*, 356*c* and 356*d* that define a cavity. The top cover defines an opening 362.

The visual indicia includes a surface of carton 350 that defines a circular opening 372 for display of a measure of volume V relative to a fill level F, similar to that described herein and which is disposed with wall 18*c*. Opening 372 is configured for selective orientation relative to wall 356*c* to facilitate visualizing material 24 within container 12, as described herein. The visual indicia includes opening 372 disposed with back wall 356*c* to display volume V relative to fill level F disposed with back wall 18*c*, oriented opposite the spout of container 12.

Opening 372 is aligned with fill level F and provides an area through wall 356*c* to view volume V relative to fill level F. Opening 372 is aligned with fill level F to provide visual indicia of an amount of volume V within container 12. For example, opening 372 is disposed adjacent wall 18*c* such that volume V is visualized through transparent or semi-transparent wall 18*c* and opening 372. Opening 372 is configured to provide a visual indicator of volume V within container 12. In some embodiments, opening 372 is configured to provide a visual comparison of volume V in container 12 with an adjacent container 12.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. Packaging comprising:

a container consisting of a handle, a shoulder, a spout, opposite top and bottom walls and a circumferential side wall connecting the top and bottom walls, inner surfaces of the walls defining an aperture configured for disposal of a volume of flowable material, the shoulder and the spout each extending from the top wall, the spout being connected to the shoulder by the handle, the handle being fixed relative to the top wall; and a carton having the container disposed therein, the carton consisting of first and second openings, opposite top and bottom covers, opposite first and second side walls and opposite third and fourth side walls, the first and second side walls each extending from the top cover to the bottom cover and from the third side wall to the fourth side wall, the third and fourth side walls each extending from the top cover to the bottom cover and from the first side wall to the second side wall, the first opening extending into the top cover and the first side wall, the spout extending through the first opening, the second opening extending into the second side wall, the openings being configured to provide visual indicia of the volume, the third and fourth side walls being free of any openings, the second side wall including a body and first and second flaps, the flaps extending from opposite sides of the body, the first flap forming a portion of the top cover, the second flap forming a portion of the bottom cover, the first flap being free of any openings between the body and an outer edge of the first flap, the second flap being free of any openings between the body and an outer edge of the second flap.

2. Packaging as recited in claim 1, wherein the visual indicia includes selective orientation of the openings with the container.

3. Packaging as recited in claim 1, wherein the material is visually perceptible from the side wall of the container.

4. Packaging as recited in claim 1, wherein the visual indicia includes alignment of the openings with transparent portions of the side wall of the container, the side wall of the container comprising opaque portions adjacent to the transparent portions.

5. Packaging as recited in claim 1, a portion of the side wall of the container is transparent and another portion of the side wall of the container is opaque.

6. Packaging as recited in claim 1, wherein a first portion of the first opening has a V-shaped configuration.

7. Packaging as recited in claim 6, wherein a second portion of the first opening extends into the top cover and has an arcuate configuration.

8. Packaging as recited in claim 7, wherein the second portion is disposed in a perpendicular orientation relative to the first portion.

9. Packaging as recited in claim 1, wherein the second opening has a diamond shaped configuration and the visual indicia includes selective orientation of the diamond shaped opening with the container.

10. Packaging as recited in claim 1, wherein the second opening has a circular configuration and the visual indicia includes selective orientation of the circular opening with the container.

11. Packaging as recited in claim 1, wherein a top surface of the spout extends parallel to a top surface of the handle.

12. Packaging as recited in claim 1, wherein the side walls of the carton extend perpendicular to the top and bottom covers.

13. Packaging as recited in claim 1, wherein the first and second side walls each extend perpendicular to the third side wall and the fourth side wall such that the carton has a rectangular cross-sectional configuration defined by the side walls of the carton.

14. Packaging comprising:

a container consisting of a shoulder, a spout, a handle, opposite top and bottom walls and a circumferential side wall connecting the top and bottom walls, the shoulder and the spout each extending from the top wall, the spout being connected to the shoulder by the handle, the handle being permanently fixed relative to the top wall, a top surface of the handle being spaced a first distance from the top wall and a top surface of the spout being spaced an increased second distance from the top wall, inner surfaces of the walls defining an aperture configured for disposal of a volume of edible and/or cooking oil that is visually perceptible from a transparent portion of the side wall; and a carton consisting of first and second openings, opposite top and bottom covers, opposite first and second side walls, opposite third and fourth walls, the first and second side walls each extending from the top cover to the bottom cover and from the third side wall to the fourth side wall, the third and fourth side walls each extending from the top cover to the bottom cover and from the first side wall to the second side wall, the first and second side walls each extending perpendicular to the third side wall and the fourth side wall such that the carton has a rectangular cross-sectional configuration defined by the side walls of the carton, inner surfaces of the walls of the carton defining a cavity, the container being disposed in the cavity such that the handle is disposed entirely within the container, the first opening extending into the top cover and the first side wall and the second opening extending into the second side wall, the spout extending through the first opening, the openings being aligned with the transparent portion of the side wall of the container to provide visual indicia of the volume, the third and fourth side walls each being free of any openings, the second side wall including a body and first and second flaps, the flaps extending from opposite sides of the body, the first flap forming a portion of the top cover, the second flap forming a portion of the bottom cover, the first flap being free of any openings between the body and an outer edge of the first flap, the second flap being free of any openings between the body and an outer edge of the second flap.

15. Packaging as recited in claim 1, wherein the handle is permanently fixed relative to the top wall and the shoulder.

16. Packaging as recited in claim 1, wherein the handle is disposed entirely within the container.

17. Packaging as recited in claim 1, wherein the top surface of the handle is spaced a first distance from the top wall and a top surface of the spout is spaced a second distance from the top wall, the second distance being greater than the first distance, the top surface of the handle extending parallel to the top surface of the spout.

18. Packaging as recited in claim 1, wherein a first surface of the shoulder is continuous with the top surface of the handle and a second surface of the shoulder is continuous with an outer surface of the side wall.

19. Packaging consisting of:

a container consisting of a shoulder, a spout, a handle, opposite top and bottom walls and a circumferential side wall connecting the top and bottom walls, the shoulder and the spout each extending from the top wall, the spout being connected to the shoulder by the handle, the handle being permanently fixed relative to the top wall, a top surface of the handle being spaced a first distance from the top wall and a top surface of the spout being spaced an increased second distance from the top wall; and a carton consisting of first and second openings, opposite top and bottom covers, opposite first and second side walls and opposite third and fourth side walls, the first and second side walls each extending from the top cover to the bottom cover and from the third side wall to the fourth side wall, the third and fourth side walls each extending from the top cover to the bottom cover and from the first side wall to the second side wall, inner surfaces of the walls of the carton defining a cavity, the container being disposed in the cavity such that the handle is disposed entirely within the container, the first opening extending into the top cover and the first side wall and the second opening extending into the second side wall, the spout extending through the first opening, the openings being aligned with a transparent portion of the side wall of the container to provide visual indicia of the volume.

20. Packaging as recited in claim 19, wherein the third and fourth side walls are free of any openings, the second side wall including a body and first and second flaps, the flaps extending from opposite sides of the body, the first flap forming a portion of the top cover, the second flap forming a portion of the bottom cover, the first flap being free of any openings between the body and an outer edge of the first flap, the second flap being free of any openings between the body and an outer edge of the second flap.

* * * * *